US005538271A

United States Patent [19]

Abondance

[11] Patent Number: 5,538,271

[45] Date of Patent: Jul. 23, 1996

[54] PLATE FOR MOUNTING A BOOT BINDING ON AN ALPINE SKI

[75] Inventor: Roger Abondance, La Murette, France

[73] Assignee: Skis Rossignol S.A., Vioron, France

[21] Appl. No.: 205,398

[22] Filed: Mar. 3, 1994

[30] Foreign Application Priority Data

Mar. 11, 1993 [FR] France ..... 93 03044

[51] Int. Cl.[6] ..... A63C 5/075

[52] U.S. Cl. ..... 280/602; 280/607; 280/617

[58] Field of Search ..... 280/602, 607, 280/610, 617, 618, 636

[56] References Cited

U.S. PATENT DOCUMENTS

| | | | |
|---|---|---|---|
| 4,974,867 | 12/1990 | Rullier et al. | 280/607 |
| 5,026,086 | 6/1991 | Guers et al. | 280/607 |
| 5,104,139 | 4/1992 | Brischoux | 280/607 |
| 5,135,250 | 8/1992 | Abondance et al. | 280/617 |
| 5,232,241 | 8/1993 | Knott et al. | 280/607 |
| 5,303,948 | 4/1994 | Masson et al. | 280/607 |
| 5,333,889 | 8/1994 | Piegay et al. | 280/607 X |

*Primary Examiner*—Eric D. Culbreth
*Assistant Examiner*—Michael Mar
*Attorney, Agent, or Firm*—Oliff & Berridge

[57] ABSTRACT

A plate, of the type including at least one plate of viscoelastic material fastened onto the upper face of the ski, in its central zone, and on the other face of which a constraining plate made of rigid material is bonded. According to the invention, the capacity of the constraining plate for deformation decreases from its front and rear ends toward its middle.

15 Claims, 4 Drawing Sheets

PLATE FOR MOUNTING A BOOT BINDING ON AN ALPINE SKI

BACKGROUND OF THE INVENTION

The subject of the present invention is a plate for mounting a boot binding on an alpine ski.

DESCRIPTION OF THE PRIOR ART

Traditionally, the toe stop and heel base constituting a safety binding are fastened onto the ski, in the central zone, directly onto the upper face thereof. The development of the technique of using skis, as well as their conception, leads to the production of skis, and especially slalom skis, whose width in the central zone is smaller than before. Now, the boot of the skier resting on this central zone overhangs laterally both lateral faces of the ski, which may result, on a steep slope, in bearing of the boot directly on the snow, actually before the corresponding edge of the ski has bitten into the snow. This results in side-slipping of the ski which can lead to imbalance, or even the skier falling.

In order to overcome this drawback, it has been envisaged to raise the boot with respect to the ski, by interposing a plate between the ski and the boot, the binding, toe stop and heel piece being mounted on this plate. There are various types of plate. Some plates are complex plates, including a layer of viscoelastic material bonded onto the upper face of the ski, a constraining plate made of rigid material, such as light metal alloy being laminated onto the other face of this layer. Such a plate has vibration-damping properties, the viscoelastic material working in compression and in shearing.

However, such a plate, despite the presence of viscoelastic material, responds to a varying degree to requirements for lack of constraint of the ski from the binding and boot assembly. Because of the presence of viscoelastic material, the force on the bindings is not transmitted directly to the ski, but the binding-plate and the boot assembly forms a rigid assembly which, despite everything, influences the simple flex deformation of the ski.

Document DE-A-2,259,375 describes a ski equipped with a plate intended for mounting the bindings, bearing on the ski at two points which are away from the central zone. This spread distribution of the load exerted by the skier on the ski is not favourable for good execution of turns. With such a device, it is difficult to obtain good precision in guiding the ski.

Document U.S. Pat. No. 2,550,002 relates to a ski including a sandwich structure composed of materials having different densities, with raising of the central zone intended for mounting the binding, and interposition of a thin rubber strip in this zone. This case involves simply raising the binding region with respect to the upper face of the ski.

SUMMARY OF THE INVENTION

The object of the invention is to provide a plate for mounting a boot binding on an alpine ski which rigidifies the ski as little as possible, in order to obtain a deformation curve of the ski assembly equipped with a plate which is as sharp as possible.

For this purpose, in the plate to which it relates, of the type including at least one plate of viscoelastic material fastened onto the upper face of the ski, in its central zone, and on the other face of which a constraining plate made of rigid material is bonded, the capacity of the constraining plate for deformation decreases from its front and rear ends towards its middle.

The improvement in the capacity of the constraining plate for deformation, in the end regions, limits the rigidifying action of the boot, binding and plate assembly, and allows the ski greater freedom of simple flex movement.

According to a first embodiment of this plate, the thickness of the upper rigid plate increases from its front and rear ends toward its middle, while the thickness of the plate of viscoelastic material increases from the middle toward the front and rear ends.

The decrease in thickness of the rigid plate in its end region gives it flexibility. This decrease in thickness of the rigid plate is accompanied by an increase in thickness of the plate of viscoelastic material. Now, the shear strength of the plate of viscoelastic material decreases with the thickness. These two combined dimensional variations, decrease in thickness of the rigid plate and increase in thickness of the plate of viscoelastic material, in the end regions, contribute to a decrease in the shearing and therefore the bending strength of the ski.

According to another embodiment of this plate, the upper rigid plate includes, in its end regions, transverse grooves. These transverse grooves may be equidistant or of variable spacing, the pitch increasing from each free end toward the middle of the plate, it being possible for the depth of the grooves to be constant or variable and decreasing from the free ends of the plate toward its middle.

According to another embodiment, the upper plate includes two longitudinal returns partially covering the plate of viscoelastic material, the height of each return increasing from each end of the plate towards the middle.

According to one variant, the upper plate has a T-shaped cross section, the upright of the T pointing downward and having a height which increases from each end of the plate toward its middle.

In these two cases, the variation in the rigidity of the plate is obtained by altering the height of the returns, the lateral returns in the first case and the central return in the second case.

According to another embodiment of this plate, the upper plate is made by superposition of several layers centered on the middle of the plate, the respective areas of the layers increasing from the one closest to the ski as far as the top one.

This change in thickness of the upper laminated plate is also accompanied by a variation in thickness of the plate of viscoelastic material, as already described above.

According to another embodiment, the area of the rigid plate is greater than that of the plate of viscoelastic material, at least a part of the end regions of the plate of viscoelastic material being set back with respect to the border of the rigid plate.

According to a first possibility in this case, the four corners of the plate of viscoelastic material are truncated.

According to another possibility in this case, the plate of viscoelastic material includes a recess of general V shape, opening in each of its end faces.

According to another embodiment, the upper plate is made from a laminate of glass and/or carbon and/or aramid fibers, with a different orientation of the fibers over the length of the plate, those situated at the middle of the plate having a more longitudinal general orientation than those situated in the end regions which have a more transverse general orientation. In the central part, where the fibers have a longitudinal general orientation, the upper plate has a capacity for deformation which is less than that of the end regions in which the fibers have a transverse general orientation. The progression of orientation of the fibers gives progression in the flexibility of the plate.

Furthermore, advantageously, the distance between the reinforcing fibers of the rigid plate and the upper face of the ski is smaller in the end regions of the plate than in its central part.

The last arrangement results in an alteration of the distance between the reinforcing fibres of the upper plate and the neutral axis of the ski. Now, it is known that, the closer the fibers are to the neutral axis, the more the bending strength is decreased. This structure therefore further promotes the flexibility of the ends of the plate.

This plate for mounting a binding may be symmetrical with respect to its transverse mid-plane, or, on the other hand, have an asymmetry with respect to this same plane, its rear part having a capacity for deformation which is greater than that of its front part, which makes it possible to favor guidance of the tip when directing the ski.

BRIEF DESCRIPTION OF THE DRAWINGS

In any case, the invention will be clearly understood, with the aid of the following description, with reference to the attached schematic drawing representing, by way of non-limiting examples, several embodiments of this plate for mounting a binding on a ski.

DESCRIPTION OF THE PREFERRED EMBODIMENTS

Figure 1:
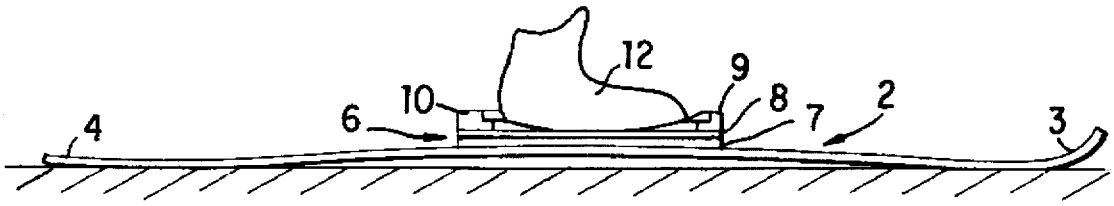
FIG. 1 is a side view which highly schematically represents the ski, plate, binding and boot assembly in the mounted position.

FIG. 1 represents a ski 2 including a tip 3, a heel 4 and a central zone 5. In the central zone 5, on the upper face of the ski, a plate 6 is fastened which includes a plate 7 bonded onto the upper face of the ski, and on the other face of which a constraining plate 8 made of rigid material is bonded. In this constraining plate 8, a toe stop 9 and a heel piece 10, intended for fastening a boot 12, are fastened, for example by screwing.

Figure 2:
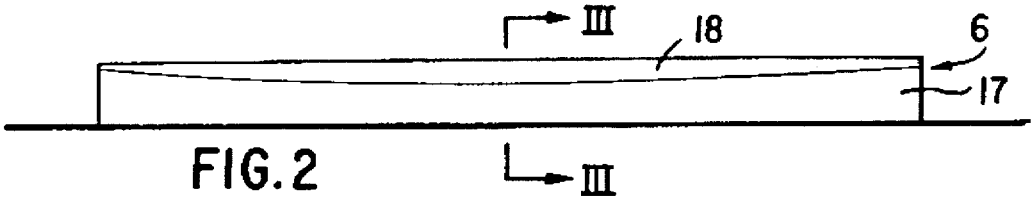
FIG. 2 is the side view of a first plate, on an enlarged scale.
Figure 3:
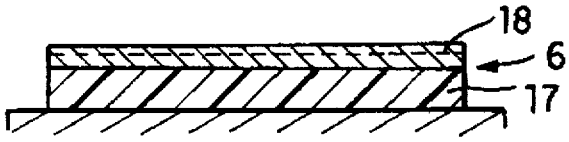
FIG. 3 is a cross-sectional view along the line III—III in FIG. 2.

In the embodiment represented in FIGS. 2 and 3, the plate 6 comprises a constraining plate 18, whose thickness increases from its front and rear edges towards its middle. On the other hand, the thickness of the plate 17 of viscoelastic material increases from the middle toward the front and rear ends. Thus, if the maximum thickness of the constraining plate lies between 5 and 10 mm, its thickness at the ends is of the order of 2 mm.

Figure 4:
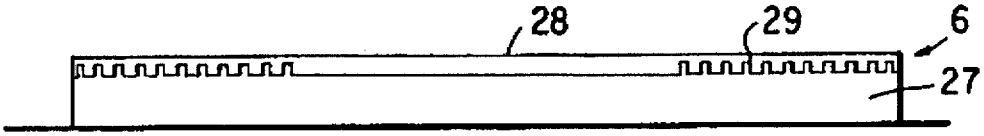
FIGS. 4 to 6 are three side views of three other plates.
Figure 5:
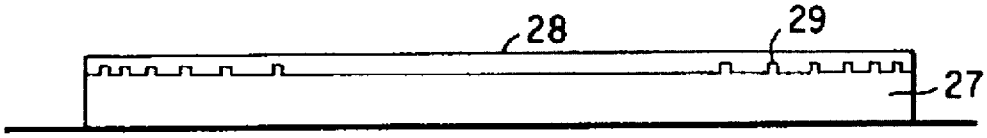

FIG. 4 represents a plate 6 including a plate 27 of viscoelastic material and an upper rigid plate 28, these having constant thicknesses over their entire lengths. In the upper plate 28, transverse grooves 29 are made which open downward. These transverse grooves 29 are arranged in the end regions of the plate, have the same depth and are equidistant. FIG. 5 is an alternative embodiment of FIG. 4, in which the separation of the transverse grooves is variable, the pitch increasing from each free end towards the middle of the plate.

Figure 6:
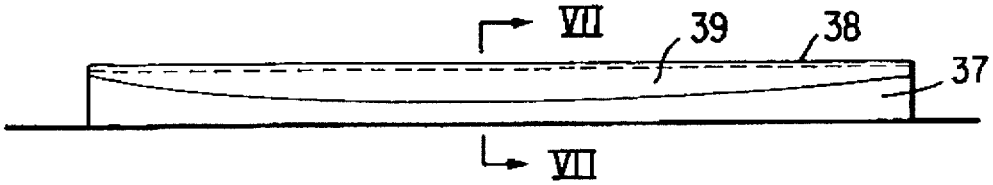
Figure 7:
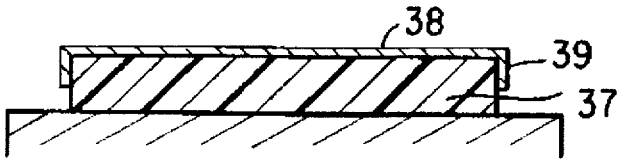
FIG. 7 is a cross-sectional view of the plate in FIG. 6, along the line VII—VII.

In the embodiment represented in FIGS. 6 and 7, the plate 37 of viscoelastic material is of constant thickness, and the upper rigid plate 38, also of constant thickness, includes two longitudinal returns 39 partially covering the plate of viscoelastic material, the height of each return 39 increasing from each end of the plate toward its middle.

Figure 8:
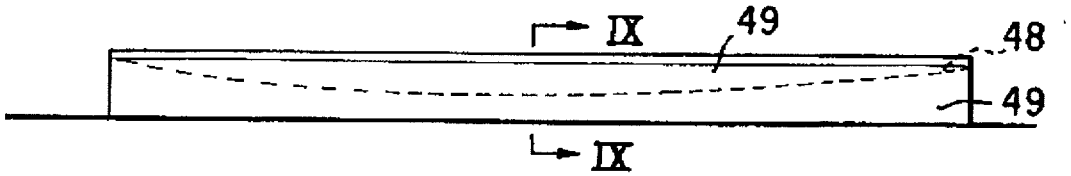
FIG. 8 is a side view of another plate.
Figure 9:
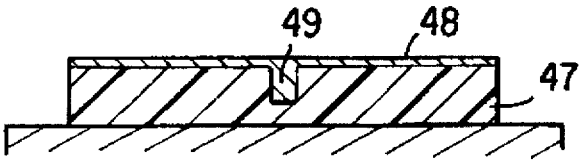
FIG. 9 is a view in section along the line IX—IX in FIG. 8.

In the embodiment represented in FIGS. 8 and 9, the plate 47 of viscoelastic material is of constant thickness, and the upper rigid plate 48 is also of constant thickness. This upper plate 48 has, as seen in cross section, a T-shaped cross section, including an upright 49 pointing downward. The height of this upright is variable, and increases from each end of the plate toward its middle.

Figure 10:
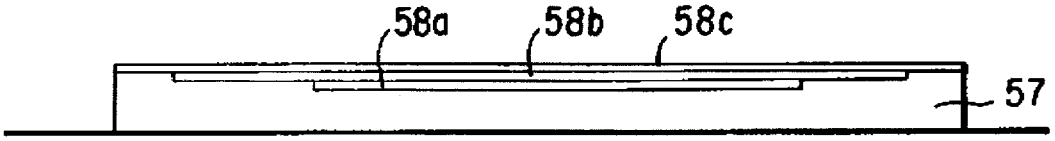
FIG. 10 is a side view of another plate.

In the embodiment of the plate 6, represented in FIG. 10, the upper plate is made by superposition of several layers 58*a*, 58*b*, 58*c*, centred on the middle of the plate the respective areas of the layers 58*a*, 58*b*, 58*c* increasing from the one closest to the ski to the one facing upward. In this case, the thickness of the layer of viscoelastic material is variable and adapted to the corresponding thickness of the plate.

Figure 11:
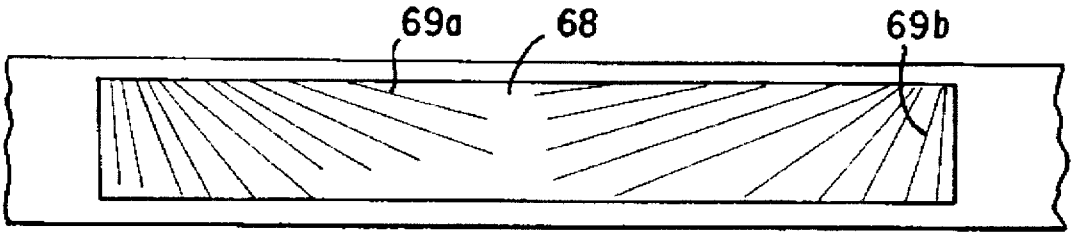
FIG. 11 is a plan view of another plate.

FIG. 11 is a plan view of another plate, in which the upper plate 68 is made of a laminate of glass fibers, carbon fibers or aramid fibers. As shown highly schematically in FIG. 11, the orientation of the fibers 69 is not the same over the entire length of the plate, the fibers 69*a* located in the central part of the plate having a more longitudinal general orientation than the fibers 69*b* situated in the end regions, which have a more transverse general orientation.

Figure 12:
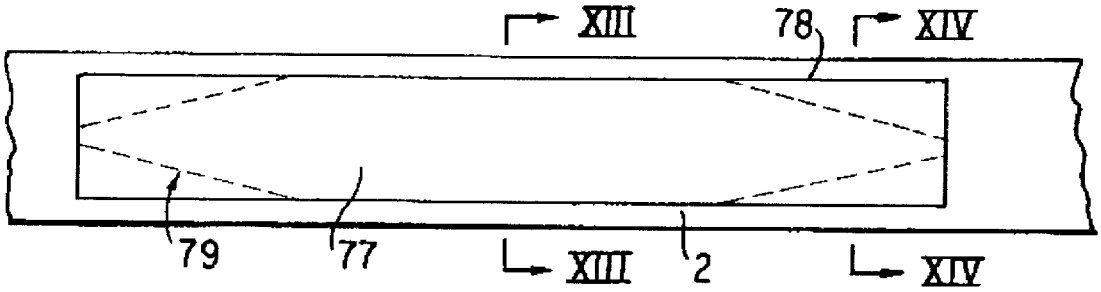
FIG. 12 is a plan view of another plate.
Figure 13:
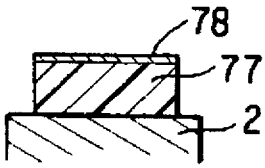
FIGS. 13 and 14 are two views in section along the lines XIII—XIII and XIV—XIV of the plate in FIG. 12.
Figure 14:
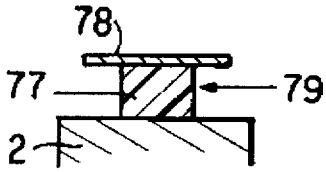

In the embodiment represented in FIGS. 12 to 14, the area of the plate 77 of viscoelastic material is less than the area of the upper rigid plate 78. This results from the fact that the four corners of the plate of viscoelastic material 77 are truncated, by a border 79 which is set back with respect to the border of the rigid plate.

Figure 15:
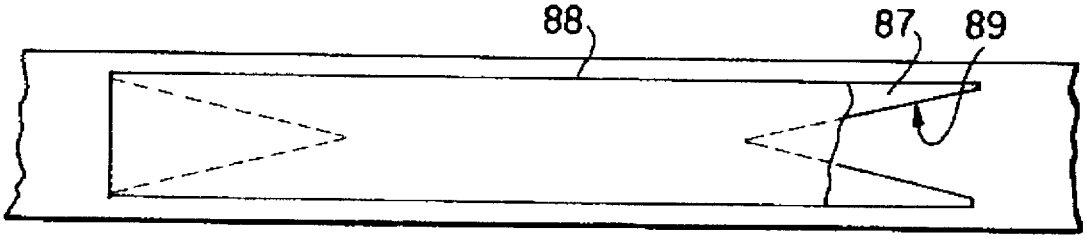
FIG. 15 is a plan view of another plate.
Figure 16A:
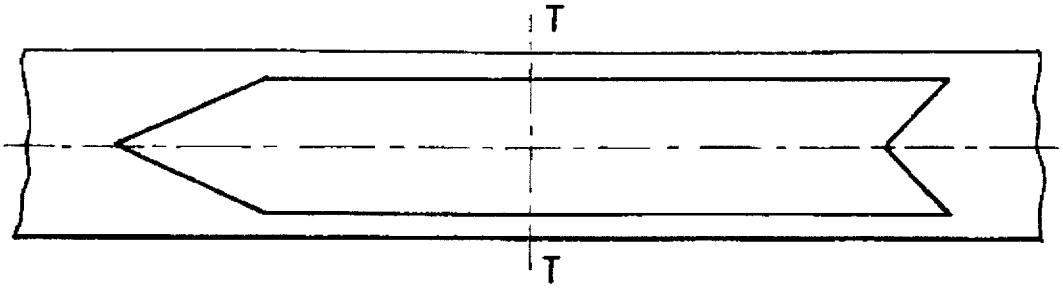
FIGS. 16(*a*)–16(*c*) show the mounting plate assembly assymetric relative to a transverse median plane T—T, lengthwise median plane L—L, and both a transverse median plane T—T, lengthwise median plane L—L.
Figure 16B:
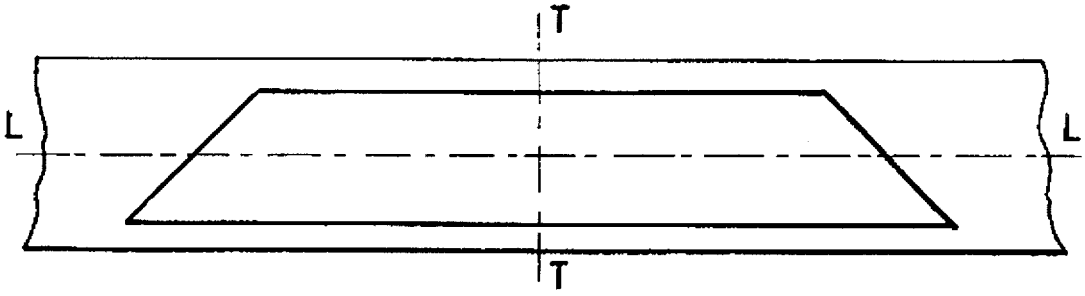
Figure 16C:
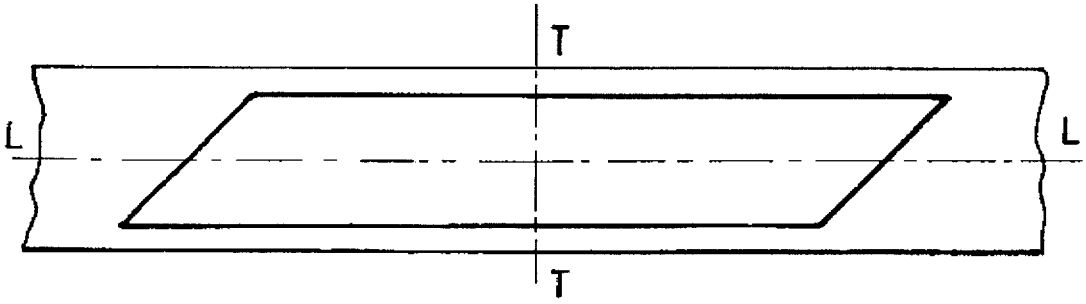

FIG. 15 represents an alternative embodiment of the plate in FIGS. 12 to 14, in which, for clarity of the drawing, the right end of the upper plate 88 has been removed, allowing the plate 87 of viscoelastic material to be seen. This plate includes, opening in each of its end faces, a recess 89. The border bounding this recess is set back with respect to the corresponding end regions of the upper rigid plate 78 which is, for its part, rectangular.

In all the above embodiments, the mounting plate for the binding of a boot has been presented with symmetry with respect to its transverse and longitudinal mid-planes. However, it is possible to envisage a dissymmetry with respect to these same planes, for example in order to obtain more flexibility in the rear part of the plate than in its front part, or alternatively, more flexibility on one side of the ski with respect to the other side, by virtue of a different capacity of these two sides for deformation.

I claim:

1. A plate assembly for mounting a boot binding on a ski, comprising:

at least one plate of viscoelastic material having a first surface attachable to an upper face of the ski in a central zone thereof, the at least one plate having a second surface; and a constraining plate made of rigid material and being attached to the second surface of the at least one plate of viscoelastic material, the constraining plate having a front portion, a rear portion, and a middle portion, wherein the capacity of the constraining plate for deformation decreases from the front and rear portions towards the middle portion, wherein the thickness of the constraining plate increases from the front and rear portions towards the middle portion, while the thickness of the at least one plate of viscoelastic material increases from a middle portion of the at least one plate of viscoelastic material toward front and rear portions thereof.

2. The plate assembly claimed in claim 1, wherein the constraining plate is made by superposition of a plurality of layers centered on the middle of the constraining plate, the respective areas of the layers increasing with increasing distance of the respective layer relative to the ski.

3. The plate assembly as claimed in claim 1, wherein the plate assembly is symmetrical with respect to transverse and longitudinal mid-planes of the plate assembly.

4. The plate assembly claimed in claim 1, wherein the plate assembly is asymmetric with respect to its transverse and/or longitudinal mid-planes, the rear part of the plate assembly having a capacity for deformation which is different from that of the front part of the plate assembly or the left side of the plate assembly having a capacity for deformation which is different from that of the right side of the plate assembly.

5. A plate assembly for mounting a boot binding on a ski, comprising:

at least one plate of viscoelastic material having a first surface attachable to an upper face of the ski in a central zone thereof, the at least one plate having a second surface, said viscoelastic material having end portions which decrease in width from a central portion to outer ends thereof and said end portions being symmetrically shaped; and a constraining plate made of rigid material and being attached to the second surface of the at least one plate of viscoelastic material, the constraining plate having a front portion, a rear portion, and a middle portion, wherein the capacity of the constraining plate for deformation decreases from the front and rear portions towards the middle portion.

6. The plate assembly as claimed in claim 5, wherein the plate assembly is symmetrical with respect to its transverse and longitudinal mid-planes.

7. The plate assembly as claimed in claim 5, wherein the plate assembly is asymmetric with respect to its transverse and/or longitudinal mid-planes, the rear part of the plate assembly having a capacity for deformation which is different from that of the front part of the plate assembly or the left side of the plate assembly having a capacity for deformation which is different from that of the right side of the plate assembly.

8. A plate assembly for mounting a boot binding on a ski, comprising:

at least one plate of viscoelastic material having a first surface attachable to an upper face of the ski in a central zone thereof, the at least one plate having a second surface; and a constraining plate made of rigid material and being attached to the second surface of the at least one plate of viscoelastic material, the constraining plate having a front portion, a rear portion, and a middle portion, wherein the capacity of the constraining plate for deformation decreases from the front and rear portions towards the middle portion irrespective of the at least one plate of viscoelastic material, said constraining plate having at least one downwardly extending plate portion extending longitudinally and transversely thereto which decreases in height towards ends of said constraining plate.

9. The plate assembly as claimed in claim 8, wherein the at least one downwardly extending plate portion of the constraining plate comprises two longitudinal returns partially covering the plate of viscoelastic material, the height of each return increasing from each end of the constraining plate toward its middle.

10. The plate assembly as claimed in claim 8, wherein the constraining plate has a T-shaped cross section, the upright of the T pointing downward and having a height which increases from each end of the constraining plate toward its middle.

11. The plate assembly as claimed in claim 8, wherein the plate assembly is symmetrical with respect to its transverse and longitudinal mid-planes.

12. The plate assembly as claimed in claim 8, wherein the plate assembly is asymmetric with respect to its transverse and/or longitudinal mid-planes, the rear part of the plate assembly having a capacity for deformation which is different from that of the front part of the plate assembly or the left side of the plate assembly having a capacity for deformation which is different from that of the right side of the plate assembly.

13. A plate assembly for mounting a boot binding on a ski, comprising:

at least one plate of viscoelastic material having a first surface attachable to an upper face of the ski in a central zone thereof, the at least one plate having a second surface; and a constraining plate made of rigid material and being attached to the second surface of the at least one plate of viscoelastic material, the constraining plate having a front portion, a rear portion, and a middle portion, wherein the capacity of the constraining plate for deformation decreases from the front and rear portions towards the middle portion irrespective of the at least one plate of viscoelastic material, said constraining plate comprising transversely extending notches within the front and rear portions therein.

14. The plate assembly as claimed in claim 13, wherein the plate assembly is symmetrical with respect to its transverse and longitudinal mid-planes.

15. The plate assembly as claimed in claim 13, wherein the plate assembly is asymmetric with respect to its transverse and/or longitudinal mid-planes, the rear part of the plate assembly having a capacity for deformation which is different from that of the front part of the plate assembly or the left side of the plate assembly having a capacity for deformation which is different from that of the right side of the plate assembly.

* * * * *